US007874639B2

(12) United States Patent
Nagata et al.

(10) Patent No.: US 7,874,639 B2
(45) Date of Patent: Jan. 25, 2011

(54) INK JET RECORDING HEAD, INK JET CARTRIDGE WITH INK JET RECORDING HEAD, AND INK JET RECORDING APPARATUS

(75) Inventors: Shingo Nagata, Kawasaki (JP); Keiichiro Tsukuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 12/063,080

(22) PCT Filed: Nov. 24, 2006

(86) PCT No.: PCT/JP2006/324045

§ 371 (c)(1),
(2), (4) Date: Feb. 6, 2008

(87) PCT Pub. No.: WO2007/061138

PCT Pub. Date: May 31, 2007

(65) Prior Publication Data

US 2009/0128600 A1 May 21, 2009

(30) Foreign Application Priority Data

Nov. 25, 2005 (JP) ..... 2005-340539

(51) Int. Cl.

| | |
|---|---|
| ***B41J 2/21*** | (2006.01) |
| ***B41J 2/15*** | (2006.01) |
| ***B41J 2/145*** | (2006.01) |
| ***B41J 2/14*** | (2006.01) |
| ***B41J 2/16*** | (2006.01) |

(52) U.S. Cl. ..... 347/43; 347/20; 347/40; 347/41; 347/44; 347/47; 347/84; 347/85; 347/86; 347/87

(58) Field of Classification Search ..... 347/40, 347/43, 47

See application file for complete search history.

(56) References Cited

U.S. PATENT DOCUMENTS

| | | | | |
|---|---|---|---|---|
| 4,746,935 | A * | 5/1988 | Allen | 347/98 |
| 6,030,065 | A | 2/2000 | Fukuhata | |
| 6,137,502 | A | 10/2000 | Anderson et al. | |
| 6,382,757 | B1 * | 5/2002 | Kakutani | 347/15 |
| 6,637,874 | B2 * | 10/2003 | Yazawa et al. | 347/86 |
| 6,830,317 | B2 * | 12/2004 | Tsuchii et al. | 347/56 |
| 6,984,025 | B2 | 1/2006 | Kaneko et al. | |
| 6,988,786 | B2 | 1/2006 | Kaneko et al. | |
| 7,175,255 | B2 | 2/2007 | Okito et al. | |

(Continued)

FOREIGN PATENT DOCUMENTS

| | | |
|---|---|---|
| EP | 1 228 876 | 8/2002 |
| EP | 2 508 868 | 12/2005 |

*Primary Examiner*—Ryan Lepisto
(74) *Attorney, Agent, or Firm*—Fitzpatrick, Cella, Harper & Scinto

(57) ABSTRACT

An ink jet recording head includes at least three nozzle array groups, each including at least two nozzle arrays with an ink supply port interposed therebetween and each ejecting a different ink. Opening areas of the ejection outlets of the nozzle arrays in each array group are of different sizes. Two adjacent nozzle array groups each include three nozzle arrays. The nozzle array group not identified as one of the two adjacent nozzle array groups is supplied with ink having a highest lightness among the three kinds of inks.

7 Claims, 8 Drawing Sheets

U.S. PATENT DOCUMENTS 7,287,847 B2 10/2007 Fujii et al.
7,350,902 B2 * 4/2008 Dietl et al. ..... 347/43
7,384,129 B2 * 6/2008 Nagata et al. ..... 347/43
2003/0214551 A1 11/2003 Yabe
2004/0021731 A1 2/2004 Yabe et al.
2006/0050107 A1 * 3/2006 Yamanaka et al. ..... 347/40
2008/0259119 A1 10/2008 Ikegame et al.

* cited by examiner (a)

(b)

(c)

(a)

(b)

| | | | |
|---|---|---|---|
|   | 403+404<br>C+M | 403+406<br>C+Y | 404+406<br>M+Y |
| | ○ | ○ | ○ |
|   | 403+404<br>M+C | 403+406<br>M+Y | 404+406<br>C+Y |
| | ○ | ○ | ○ |

INK JET RECORDING HEAD, INK JET CARTRIDGE WITH INK JET RECORDING HEAD, AND INK JET RECORDING APPARATUS

TECHNICAL FIELD

The present invention relates to an ink jet recording head, which records an image by ejecting liquid such as ink. It also relates to an ink jet cartridge equipped with an ink jet recording head, and a recording apparatus equipped with an ink jet recording head.

BACKGROUND ART

In order to achieve a high level of image quality which is as high as that achievable by silver salt photography, with the use of an ink jet recording, it is necessary to reduce the ink jet recording head in ink droplet size, to a degree that it is difficult to see the individual dots formed by the ink droplets from the ink jet recording head. Thus, various ink jet recording heads have been devised, which are roughly 5 pl (pico liter: $10^{-12}$ liter) in ink droplet size, 40-50 μm in dot size, and 600×1200-1200×1200 dpi in resolution. Some of them have been put to practical use.

However, in order to satisfy users who want to further reduce an ink jet recording head in the graininess of the halftone areas and highlight areas of a photographic color image which the ink jet recording head forms, the ink jet recording head must be further reduced in ink droplet size; more specifically, the ink jet recording head must be enabled to jet ink droplets which are roughly 2 pl in volume. Obviously, reducing an ink jet recording head in ink droplet size is effective to satisfy the abovementioned user need. However, it unnecessarily reduces the speed at which an ink jet recording head prints a color image which does not need to be printed in high resolution. In other words, it is undesirable from the standpoint of high speed printing.

Thus, various ink jet recording heads structured so that they can be switched in ink droplet size, for example, between roughly 5 pl and roughly 2 pl, have been proposed. When these ink jet recording heads are used for forming a color image, such as an accounting table or a graph, which does not need to be printed in high resolution (in relative terms), they can be set to a relatively large ink droplet size, for example, 5 pl, to achieve a higher image formation speed. However, when they are used for printing a highly precise photographic color image, such as a digital photographic color image, they can be set to a relatively small ink droplet size, for example, 2 pl, to print a high quality image.

Described below are some of the well-known ink jet recording heads which have multiple sets of nozzles, which are different in ink droplet volume.

For example, the specification of U.S. Pat. No. 6,137,502 discloses an ink jet recording head in which ink ejecting openings for ejecting ink droplets of a large size, and ink ejecting openings for ejecting ink droplets of a small size, are arranged so that they are alternately positioned in a zigzag pattern.

The specification of U.S. Pat. No. 6,030,065 discloses an ink jet recording head which has first and second sets of nozzles, which are different in nozzle diameter. In the case of this ink jet recording head, each nozzle is changeable in the diameter of the dot it forms on recording medium, within a preset range, by changing it in the diameter of the ink droplet it jets. The dot diameter ranges of the first and second sets of nozzles partially overlap. Referring to FIG. 9, the specification of this U.S. Pat. No. 6,030,065 also discloses an ink jet recording head, which has sections 10Y, 10M, 10C, and 10K. Each section has a set of small diameter nozzles 12 aligned in the secondary scan direction, and a set of large diameter nozzles 14 aligned in the secondary scan direction; two columnar sets of nozzles in each section are parallel to each other. Further, in terms of the primary scan direction, the four sections are positioned so that the large diameter nozzle sets and small diameter nozzle sets are alternately positioned.

The specification of U.S. Patent Application Publication No. 2003/0214551 discloses an ink jet recording head having multiple ink supply passages for supplying multiple ink ejecting nozzles with ink. This ink jet recording head has a first set of nozzles for ejecting large liquid droplets, a second set of nozzles for ejecting smaller liquid droplets compared to the liquid droplets jetted by the first set of nozzles, and multiple (two) ink supply passages. The first and second sets of nozzles, and the set of liquid supply openings, are aligned in a preset direction, with the two sets of nozzles positioned between the two liquid supply passages.

Further, the specification of U.S. patent Application Publication No. 2004/0021731 discloses an ink jet recording head having multiple (two) first nozzle sets made up of first nozzles which jet liquid droplets of a large size, and a second nozzle set made up of second nozzles which jet liquid droplets smaller than the liquid droplets jetted by the first nozzles. The second nozzle set is positioned between the two first nozzle sets.

The inventors of the present invention made an ink jet recording head in which the volume of each ink droplet jetted by a small diameter nozzle 12 was 2 pl, and the volume of each ink droplet jetted by a large diameter nozzle 14 was 5 pl. The results of the recording tests conducted using this ink jet recording head are as follows. When this ink jet recording head was used to print solid images of a secondary color by ejecting small droplets of magenta and cyan inks, it was likely to yield images which were conspicuously nonuniform. This result seems to be traceable to the following causes. One of the causes is that the smaller the size of a primary ink droplet, the smaller the difference in size between a primary ink droplet, and a secondary ink droplet (satellite ink droplet). The satellite ink droplets are the microscopic ink droplets which are generated as a primary ink droplet is jetted, and are substantially smaller in size than the primary ink droplet. Another cause is that the smaller the size of a primary ink droplet, the greater the number of the resultant satellite ink droplets.

For the purpose of solving the above described problem, it is effective to increase the pass number, that is, the number of times an ink jet head is moved in the primary scan direction across a given area of recording medium to form an image on the recording medium. However, this method directly increases the length of time it takes for an ink jet recording head to complete an image, being therefore undesirable from the standpoint of forming a high quality image at a high speed.

Thus, the inventors of the present invention further studied the mechanism responsible for the formation of a nonuniform image, from a new standpoint, that is, from the standpoint of color (ink) combination for generating a secondary color. As a result, the inventors of the present invention discovered an innovative solution to the above described problem. That is, the inventors discovered that the problem can be solved by changing an ink jet recording head in the arrangement of the nozzles for ejecting ink droplets of the small size.

DISCLOSURE OF THE INVENTION

The present invention was made based on the abovementioned innovative solution, and its primary object is to provide an ink jet recording head which is provided nozzles capable of ejecting ink droplets substantially smaller in size than those jetted by an ink jet recording head in accordance with the prior art, in order to yield an image substantially higher in quality than an image formed by an ink jet recording head in accordance with the prior art, and yet, is capable of forming a high quality image at a high speed.

According to an aspect of the present invention, there is provided an ink jet recording head comprising at least three nozzle array groups; each of said nozzle array groups including, a first nozzle array including a plurality of ejection outlets for ejecting ink, and a second nozzle array including a plurality of ejection outlets for ejecting the ink, said second nozzle array being disposed adjacent to said first nozzle array with an ink supply port for supplying the ink interposed therebetween, wherein an opening area of the ejection outlets of the second nozzle array is smaller than an opening area of the ejection outlets of first nozzle array, wherein said nozzle array groups eject three different kinds of inks, respectively, when said ink jet recording head moves relative to a recording material, wherein said nozzle arrays of adjacent ones of said nozzle array group are arranged in the order of said first nozzle array of one of said adjacent nozzle array groups, said second nozzle array of said one of said adjacent nozzle array groups, said second nozzle array of the other one of said adjacent nozzle array groups, and said first nozzle array of the other one of said adjacent nozzle array groups; and said recording head further comprising a third nozzle array provided in each of said adjacent ones of said nozzle array groups, said third nozzle array including a plurality of ejection outlets for ejecting the ink, wherein an opening area of the ejection outlets of the third nozzle array is smaller than an opening area of the ejection outlets of the second nozzle array, wherein said third nozzle array being disposed in the same side as said second nozzle array with respect to said ink supply port, and wherein said nozzle array group which does not constitute said adjacent nozzle array groups is supplied with the ink having a highest lightness among the three kinds of inks.

This structural arrangement places sets of ink ejecting openings for ejecting liquid droplets of a relatively small size, which are likely to form a conspicuously nonuniform image, as close as possible to each other to prevent the formation of a conspicuously nonuniform image.

According to the present invention, it is possible to form an image in such a manner that the nonuniformity of the image, which is thought to be attributable to the landing of satellite ink droplets on recording medium, is as inconspicuous as possible. Therefore, it is possible to form a high quality image at a high speed.

These and other objects, features, and advantages of the present invention will become more apparent upon consideration of the following description of the preferred embodiments of the present invention, taken in conjunction with the accompanying drawings.

BEST MODE FOR CARRYING OUT THE INVENTION

Hereinafter, the preferred embodiments of the present invention will be described with reference to the appended drawings. Not only is an ink jet recording head in accordance with the present invention usable with an ordinary printing apparatus, but also, a copying machine, a facsimile machine having a communication system, a word processor having a printing section, a multifunction recording apparatus capable of performing the functions of two or more of the preceding apparatuses, etc.

First, an ink jet cartridge to which the present invention is applicable, and an ink jet recording apparatus compatible with an ink jet cartridge in accordance with the present invention, will be described in detail.

(1) Ink Jet Cartridge

Figure 1:
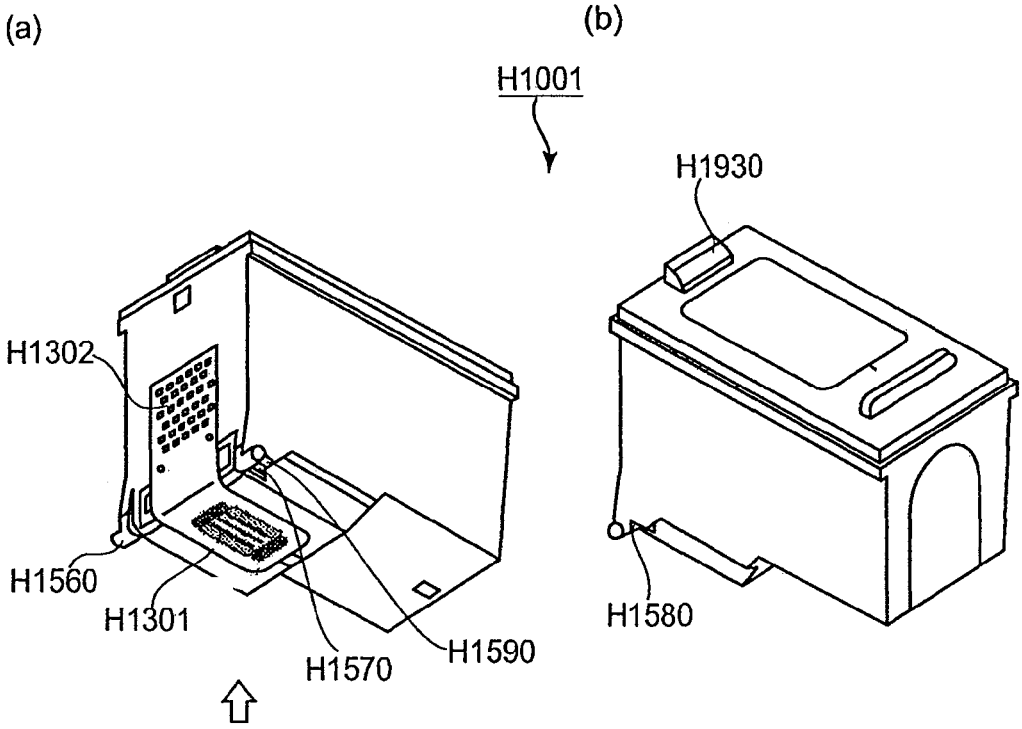
FIG. 1(*a*) is a perspective view of one of the ink jet cartridges in accordance with the present invention, and FIG. 1(*b*) is a perspective view of the same ink jet cartridge as the one in FIG. 1(*a*), as seen from a direction different from the direction from which the ink jet cartridge is seen.
Figure 3:
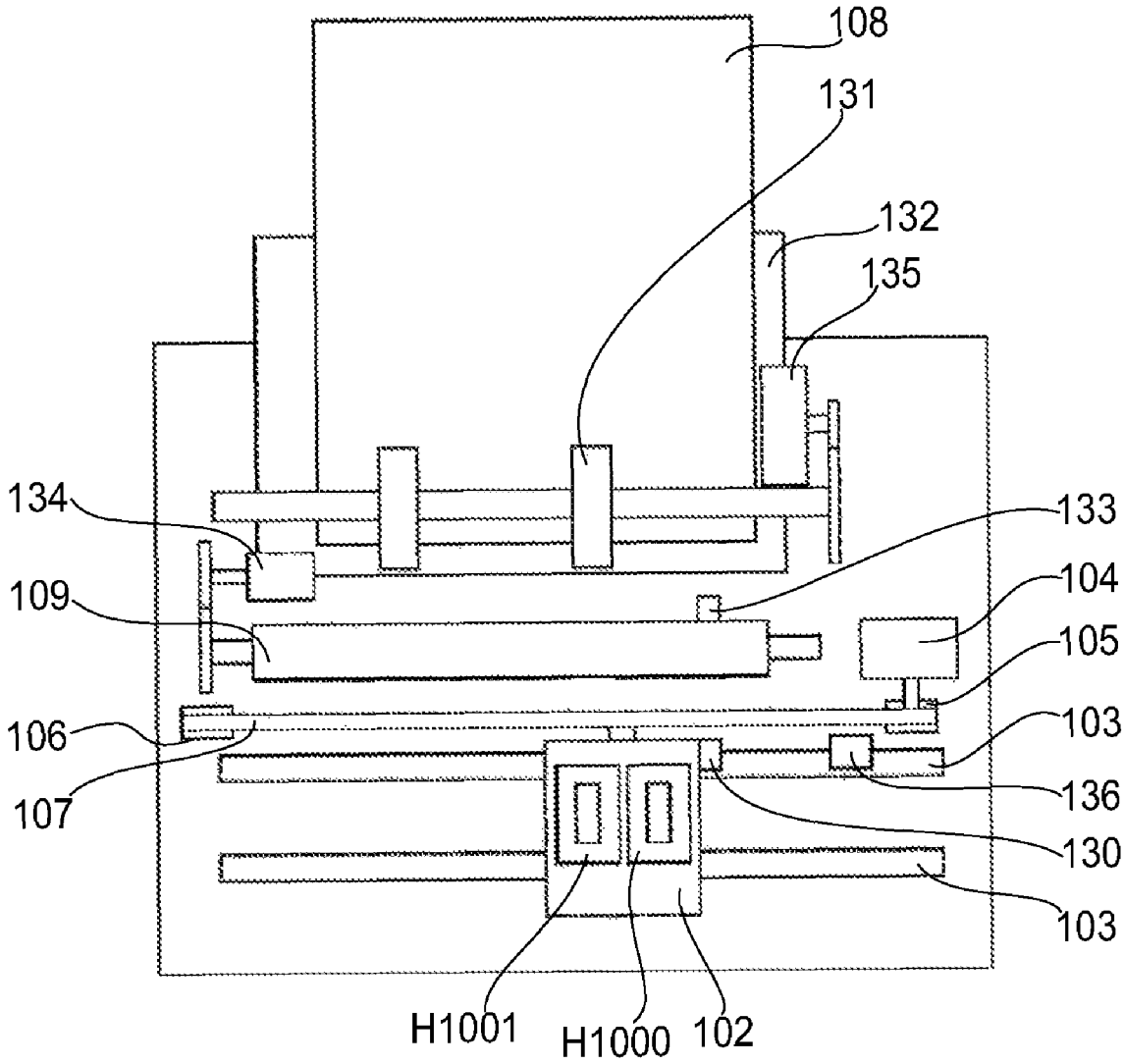
FIG. 3 is a schematic drawing of an ink jet recording apparatus which is holding the ink jet cartridge shown in FIG. 1.
Figure 8:
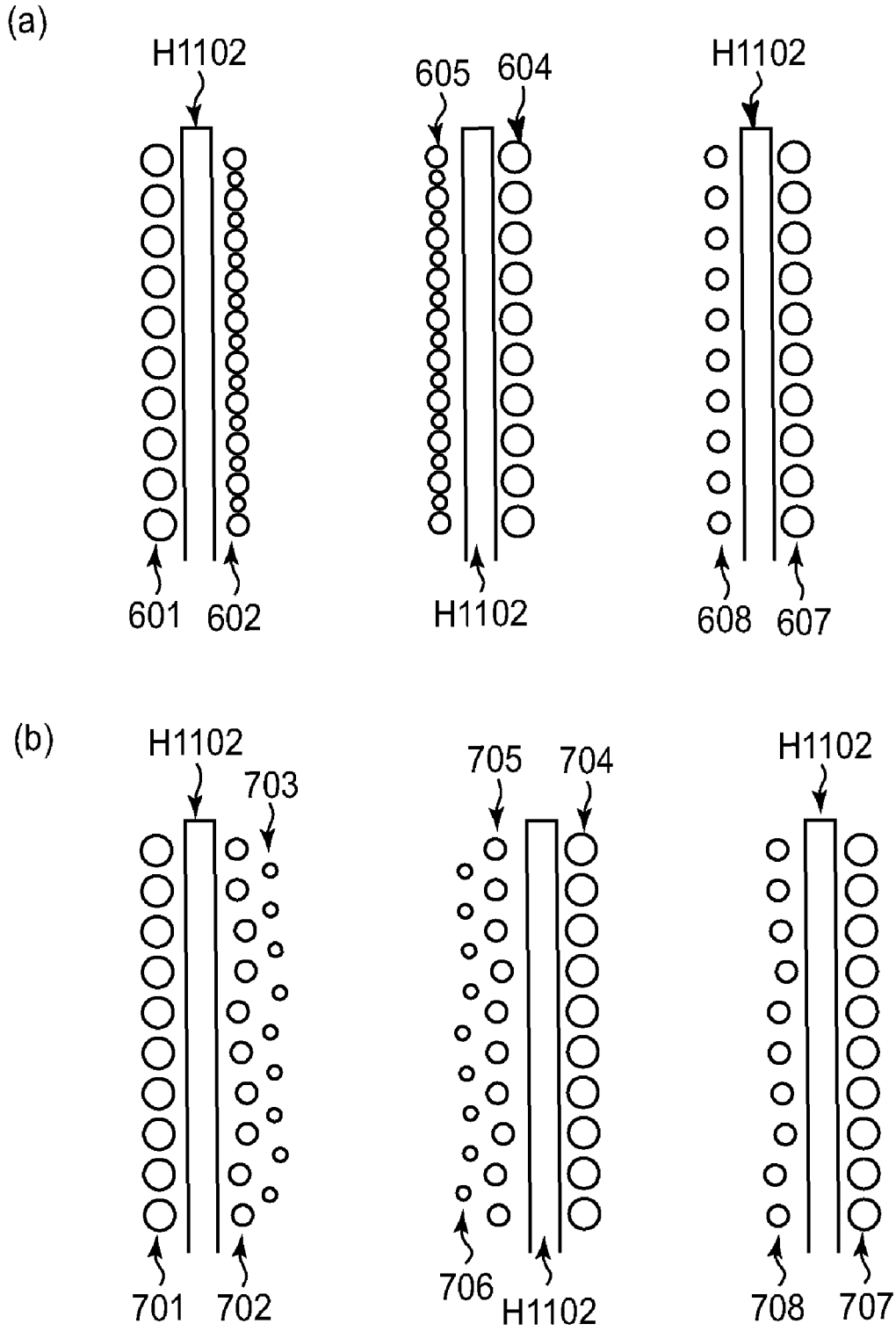
FIG. 8(*a*) is a schematic drawing which shows the arrangement of the ink ejecting opening of the recording element mounted in the ink jet cartridge in one of the modifications of the preferred embodiments of the present invention, and FIG. 8(*b*) is a schematic drawing which shows the arrangement of the ink ejecting openings of the recording element mounted in the ink jet cartridge in another modification of the preferred embodiments.
Figure 9:
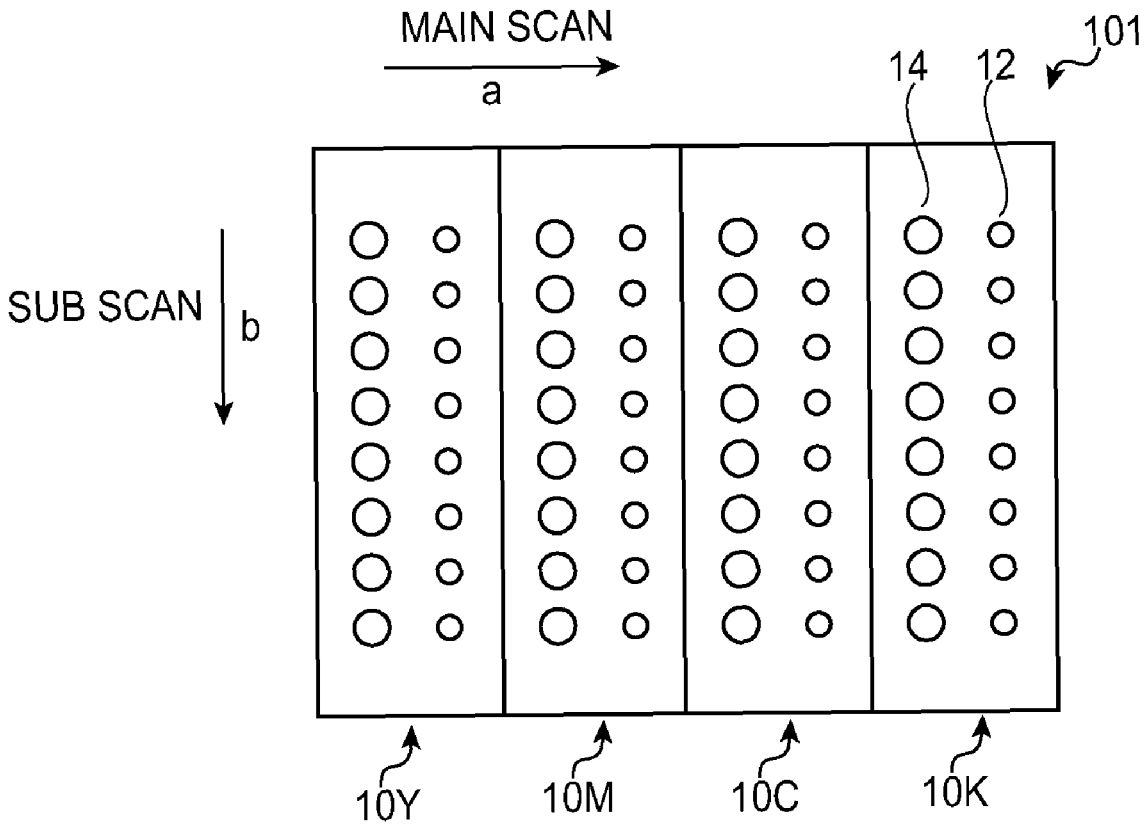
FIG. 9 is a schematic drawing which shows an example of the arrangement of the ink ejecting openings of the ink jet recording head of an ink jet cartridge in accordance with the prior art.

Referring to FIG. 1, an ink jet cartridge H1001 in accordance with the present invention has an ink jet recording head which jets ink, and an ink container in which the ink to be supplied to the ink jet recording head is stored. The ink jet recording head and ink container are integral. The ink jet cartridge H1001 holds color inks (cyan, magenta, and yellow inks). Referring to FIG. 8 3, this ink jet cartridge H1001 is removably supported by a carriage 102 of the main assembly of an ink jet recording apparatus, being properly positioned relative to the carriage 102 by a positioning means, with its electrical contacts connected to the counterparts on the main assembly side. The ink jet cartridge H1001 is to be replaced as the inks therein are depleted by consumption.

The ink jet cartridge H1001 in this embodiment is an integral combination of the recording head and ink container. The recording head is made up of electrothermal transducer elements for generating the thermal energy for boiling ink in response to electrical signals. The ink jet recording head is of the so-called side shooter type, that is, an ink jet recording head in which the electrothermal transducer elements, and the openings through which ink droplets are jetted, are positioned so that each electrothermal transducer element opposes the corresponding opening.

(1-1) Recording Element

Figure 2:
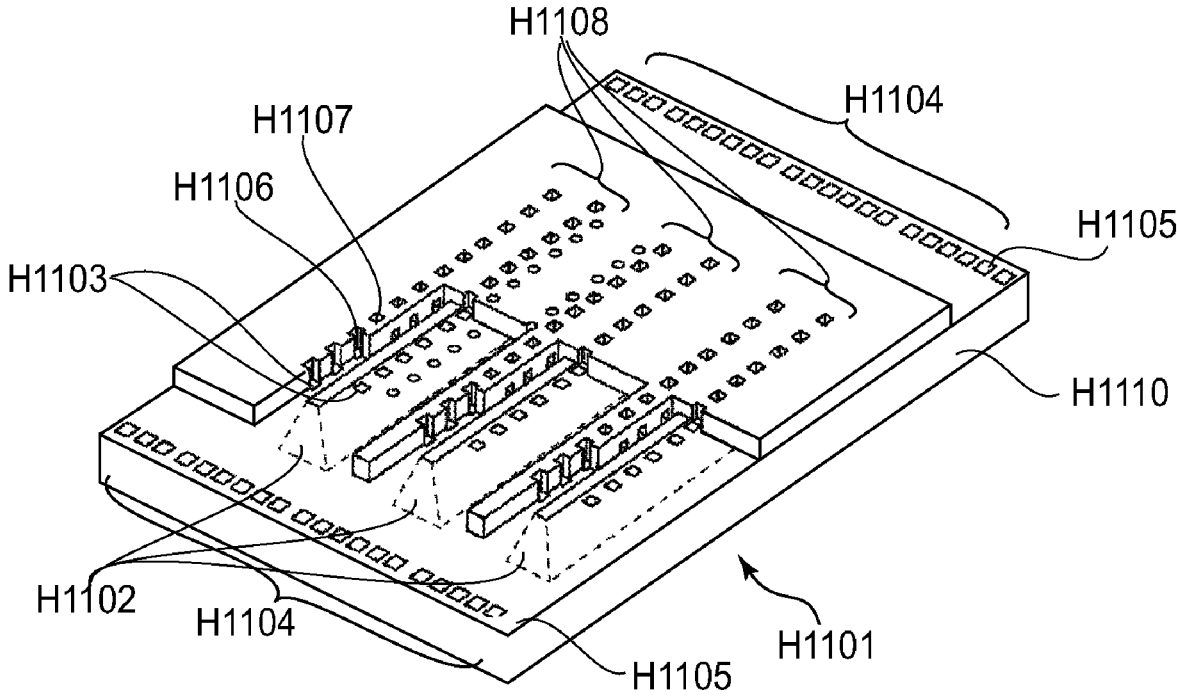
FIG. 2 is a partially cutaway perspective view of the recording element of the ink jet cartridge shown in FIG. 1.

FIG. 2 is a partially cutaway perspective view of the recording element H1101, showing the general structure thereof. The recording element H1101 has: three ink supply openings H1102, which extend in parallel; six sets of electrothermal transducer elements H1103; and six sets of ink ejecting openings H1107. The sets of ink ejecting openings are paired to form three ink ejecting sections H1108. The sets of electrothermal transducer elements H1103 and sets of ink ejecting openings H1107 are disposed so that each electrothermal transducer element is positioned on the opposite side of the ink supply opening H1102 from the corresponding ink ejecting opening H1107. The recording element H1101 is also provided with electrical wiring, fuses, electrodes, etc., which are on the substrate H1110 of the recording element H1101. On the surface of the substrate of the recording element H1101, a structural component is formed of a resinous substance in a manner to cover the abovementioned ink supply passages H1102, electrothermal transducer elements, etc., making up ink passage walls H1106, ink ejecting openings H1107, etc. Further, the recording element H1101 is provided with an electrode portion H1104 for supplying the electric wiring with electric power. The electrode portion H1104 is provided with bumps H1105 formed of Au or the like.

(1-2) Mounting of Ink Jet Cartridge into Main Assembly of Ink Jet Recording Apparatus Referring to FIG. 1, the ink jet cartridge H1001 is provided with a guide H1560 for guiding the ink jet cartridge H1001 to the correct cartridge position on the carriage 102, and a catch H1930 for securing the ink jet cartridge H1001 to the carriage 102 with the use of an unshown head setting lever. The ink jet cartridge H1001 is also provided with an ink jet cartridge positioning portion H1570 for correctly placing the ink jet cartridge H1001 into the preset ink jet cartridge position on the carriage 102, in terms of the direction X (primary scan direction of carriage 102), an ink jet cartridge positioning portion 1580 for correctly placing the ink jet cartridge H1001 into the preset ink jet cartridge position on the carriage 102, in terms of the direction Y (recording medium conveyance direction), and an ink jet cartridge positioning portion 1590 for correctly placing the ink jet cartridge H1001 into the preset ink jet cartridge position on the carriage 102 in terms of the direction Z (ink ejecting direction).

As the ink jet cartridge H1001 is correctly positioned relative to the carriage 102 by the abovementioned ink jet cartridge positioning portions H1570, H1580, and H1590, electrical connection is established between the external signal input terminals H1302 on an electric wiring tape H1301, and the contact pins (unshown) of the electrical contact portion located in the carriage 102.

Described above is the general structure of the ink jet cartridge H1001, that is, an integral combination of the ink jet recording head and ink container. However, the present invention is also applicable to an ink jet cartridge different in structure from the above described one. For example, the present invention is also applicable to an ink jet cartridge which is separable into a section which holds ink, and a recording element, as long as it falls within the technical scope of the present invention. Incidentally, designated by a referential symbol H1000 is an ink jet cartridge which stores only black ink.

(2) Ink Jet Recording Apparatus

Next, an ink jet recording apparatus in which an ink jet cartridge such as the above described ink jet cartridge H1001 is mountable will be described. FIG. 3 is a schematic drawing of an example of a recording apparatus in which the ink jet cartridge H1001 in accordance with the present invention, and the ink jet cartridge H1000 which stores only black ink, are mountable.

In the ink jet recording apparatus shown in FIG. 3, the ink jet cartridge H1001 shown in FIG. 1, which is removably mountable on the carriage 102, is on the carriage 102, being correctly positioned relative to the carriage 102. The carriage 102 is provided with an electrically connective portion for transmitting driving signals, etc., to each nozzle through the corresponding external signal input terminals on the ink jet cartridges H1000 and H1001.

The carriage 102 is supported by a guide shaft 103 with which the apparatus main assembly is provided. The guide shaft 103 extends in the primary scan direction. Further, the carriage 102 is supported by the guide shaft 103 so that it is reciprocally movable along the guide shaft 103. Not only is the carriage 102 driven by a primary scan motor 104 through a driving mechanism made up of a motor pulley 105, a follower pulley 106, a timing belt 107, etc., but also controlled in position and movement. Moreover, the carriage 102 is provided with a home position sensor 130, making it possible to detect the carriage position when the home position sensor 130 on the carriage 102 passes by a shielding plate 136.

As a pair of pickup rollers 131 is rotated by a paper feeder motor 135 through a gear train, sheets of recording medium 108 such as sheets of printing paper or thin plastic plate are fed into the apparatus main assembly from an automatic sheet feeder (ASF) 132, while being separated one by one. Then, each sheet of recording medium 108 is conveyed (moved in the secondary scan direction) by the rotation of a conveyance roller 109 to the area (printing area) in which each sheet of recording medium 108 faces the surface of each of the ink jet recording heads of the ink jet cartridges H1000 and H1001, which have the ink ejecting openings. The conveyance roller 109 is driven by the rotation of an LF (line feed) motor 134 through a gear train. Whether or not the recording medium 108 is being fed into the main assembly and the registration point for the recording medium 108 are determined when the recording medium 108 passes by a paper end sensor 133. Further, the paper end sensor 133 is also used to detect the actual location of the trailing edge of the recording medium 108, and calculate the current printing point on the recording medium 108 from the detected actual location of the trailing edge.

Incidentally, in order to keep flat the printing surface of the recording medium 108 in the printing area, the recording medium 108 is supported by a platen (unshown) from the back side. As for the ink jet cartridges H1001 and H1001 on the carriage 102, they are held by the carriage 102 so that the surfaces of the ink jet cartridges H1001 and H1001, which have the ink ejecting openings, are positioned below the bottom of the carriage 102, and also, so that the surfaces are parallel to the portion of the recording medium 108, which is between the two pairs of conveyance rollers.

The ink jet cartridges H1000 and H1001 are mounted on the carriage 102 so that the direction in which the ink ejecting openings H1107 of the ink jet recording heads are aligned is perpendicular to the primary scan direction (direction in which carriage 102 is moved relative to recording medium). Recording is made by ejecting ink from these ink ejecting openings 1107.

Next, the nozzle arrangement of the ink jet recording head, which is the primary concern of the present invention, will be described.

Incidentally, in the following description of the nozzle arrangements, the ink ejecting opening constitutes one of the two ends of each nozzle. In practical terms, "ink ejecting opening" is identical in meaning to "nozzle", and "set of ink ejecting openings" is identical to "set of nozzles".

Figure 5:
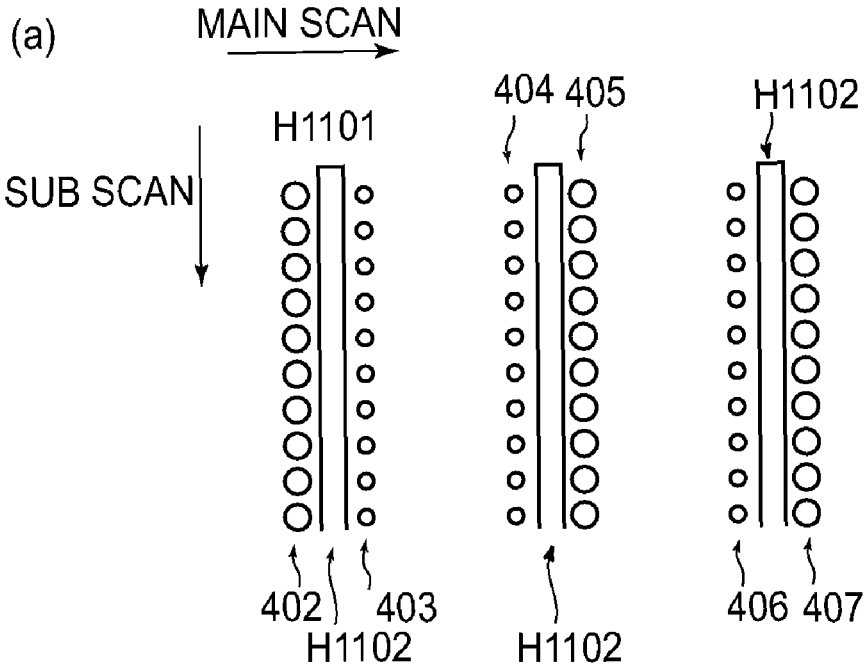
FIG. 5(*a*) is a schematic drawing which shows the arrangement of the ink ejecting openings of the referential example of an ink jet recording head in accordance with the present invention, and FIG. 5(*b*) is a table which comparatively shows the results of test carried out to find out the differences in the nonuniformity among the images which are formed with the use of the referential ink jet recording head in accordance with the present invention, and are different in ink combination and nozzle set combination.
Figure 5:
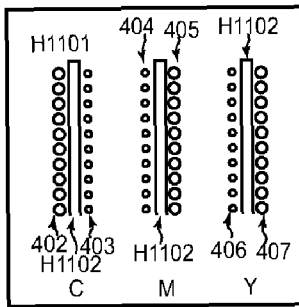
Figure 5:
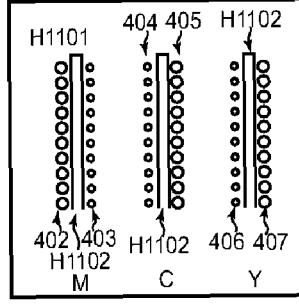

FIG. 5(*a*) is a schematic drawing of the abovementioned ink jet cartridge H1001 in the referential embodiment of the present invention, showing the arrangement of the ink ejecting openings (nozzles), as observed from the direction indicated by an arrow in FIG. 1(*a*). The ink jet recording head has multiple (three in this case) ink ejecting sections H1108, and each ink ejecting section has multiple (two) sets of ink ejecting openings aligned in a single column. Hereafter, these sets of ink ejecting openings will be referred to as first ink ejecting opening set 402, second ink ejecting opening set 403, third ink ejecting opening set 405, fourth ink ejecting opening set 404, fifth ink ejecting opening set 407, and sixth ink ejecting opening set 406. As to the intervals among these sets, the distance between the second ink ejecting opening set 403 and fourth ink ejecting opening set 404 is 2.138 mm; the distance between the fourth ink ejecting opening set 404 and sixth ink ejecting opening set 406 is 2.371 mm; the distance between the second ink ejecting opening set 403 and sixth ink ejecting opening set 406 is 4.509 mm. The first ink ejecting opening set 402 is on the opposite side of the corresponding ink supply passage H1102 from the second ink ejecting opening set 403; the third ink ejecting opening set 405 is on the opposite side of the corresponding ink supply passage H1102 from the fourth ink ejecting opening set 404; and the fifth ink ejecting opening set 407 is on the opposite side of the corresponding ink supply passage H1102 from the sixth ink ejecting opening set 406. The multiple ink ejecting opening sets 402-406 are parallel to each other.

This structural arrangement makes it possible to supply the ink jet recording head with multiple (three) inks different in type, through the three ink supply passages H1102, one for one. That is, the two ink ejecting opening sets which oppose each other across the ink supply passage H1102 are supplied with the same ink from the ink supply passage H1102 which is between the two ink ejecting opening sets. Therefore, the first and second ink ejecting opening sets 402 and 403 are the same in the color of the ink they jet; the third and fourth ink ejecting opening sets 405 and 404 are the same in the color of the ink they jet; and the fifth and sixth ink ejecting opening sets 407 and 406 are the same in the color of the ink they jet. Incidentally, each opening of the first, third, and fifth ink ejecting opening sets 402, 405, and 407 (large nozzle sets) is given a proper size for ejecting ink droplets, the volume of which is 5 pl (which hereafter will be referred to as 5 pl ink droplet). The ink passage which leads to each ink ejecting opening, and the electrothermal transducer element in each ink passage, are adjusted in measurement according to the measurement of the ink jet opening. As for each ink ejecting opening of the second, fourth, and sixth ink ejecting opening sets 403, 404, and 406 (small nozzle sets), it is given a proper size for ejecting ink droplets, the volume of which is 2 pl (which hereafter will be referred to as 2 pl ink droplet). The ink passage which leads to each of these ink ejecting openings, and the electrothermal transducer element in each of these ink passage, are adjusted in measurement according to the measurement of the ink jet opening.

The above described ink jet cartridge was used for recording, with the ink ejecting opening sets assigned to yellow (Y), cyan (C), and magenta (M), respectively, as shown in FIG. 5(*b*). The recording is made with the use of two inks different in color. FIG. 5(*b*) also shows the results of the recording.

More specifically, solid images were recorded with the use of two ink ejecting opening sets for ejecting small ink droplets (small nozzle sets), with the two ink ejecting opening sets rendered different in ink color. The solid images were recorded with a duty ratio of 50%, and the solid image is recorded on the recording medium (PR 101: product of Canon) by moving the recording head only in one direction in the primary scan direction. Thereafter, the recording mediums were read by a scanner (CanoScan LiDE80: product of Canon), and the images thereon were turned into black monochromatic images using an imaging software (Photoshop 7.0.1: product of Adobe System Co., Ltd.)

Then, the results of the recording were evaluated using three grades in terms of the standpoint described below. The images, such as the one shown in FIG. 4(*a*), in which no nonuniformity was detectable were evaluated as "o". The images, such as the one shown in FIG. 4(*b*), in which a relatively small amount of nonuniformity was detectable, were evaluated as "Δ". Lastly, the images, such as the one shown in FIG. 4(*c*), the nonuniformity of which was clearly detectable were evaluated as "x".

Figure 4:
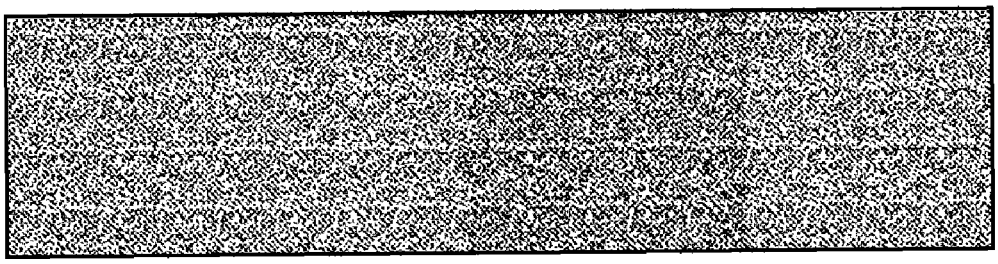
FIGS. 4(*a*)-4(*c*) are drawings which show solid images different in the state of nonuniformity, one for one.
Figure 4:
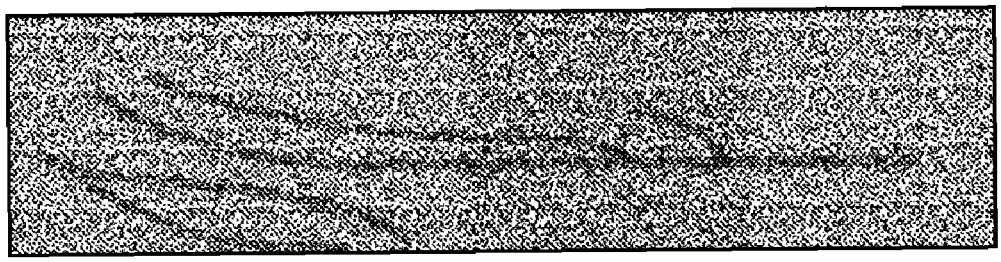
Figure 4:
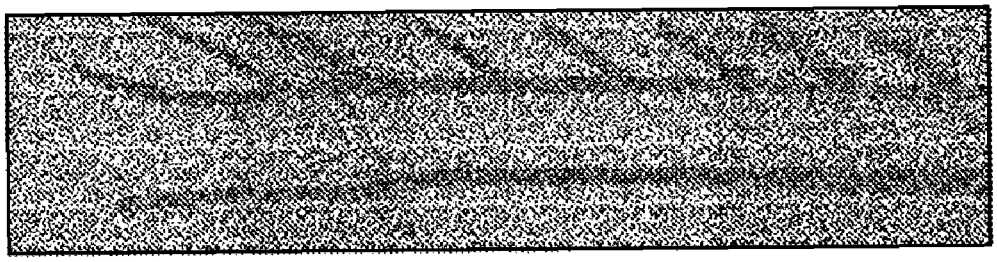

Regardless of the combination of two inks different in color, no image, such as those shown in FIGS. 4(*b*) and 4(*c*), was formed; it was possible to obtain excellent images. The reason for this success was thought to be as follows. That is, when the distance between the two ink ejecting opening sets used for image formation is large, the satellite ink droplets generated by each ink ejecting opening set float in the unstable air flow which occurs in the space between the ink ejecting opening, and the recording medium, resulting in the formation of a nonuniform image. On the contrary, when the distance between the two ink ejecting opening sets used for image formation is small, the satellite ink droplets generated by each ink ejecting opening set are less likely to float in the unstable air generated in the abovementioned space, and therefore, are less likely to contribute to the formation of a nonuniform image. Incidentally, in the case of an image formed with the use of the ink combination which includes yellow ink, yellow ink, which is higher in lightness, is thought to render the nonuniformity of the image less conspicuous, even though the amount by which the satellite ink droplets are generated by each of the ink combinations which include yellow ink is the same as the amount by which the satellite ink droplets are generated by each of the ink combinations which do not include yellow ink.

In this referential embodiment, the distance between the sixth ink ejecting opening set 406 (set of small nozzles) for ejecting yellow ink droplets and each of the second and fourth ink ejecting opening sets 403 and 404 (set of small nozzle) for ejecting ink other than yellow ink is relatively small, being therefore desirable. Incidentally, in the case of a solid image of the secondary color, which is formed by ejecting large ink droplets, the primary ink droplet is far greater in size than the satellite ink droplet, and in addition, it is smaller in the number of the satellite ink droplets generated during the formation of the image. Therefore, a nonuniform image is very unlikely to be formed; the nonuniformity is inconspicuous. Thus, the distances among the sets of large nozzles do not matter.

Next, the ink jet recording heads in the preferred embodiments of the present invention will be described.

Embodiment 1

Figure 6:
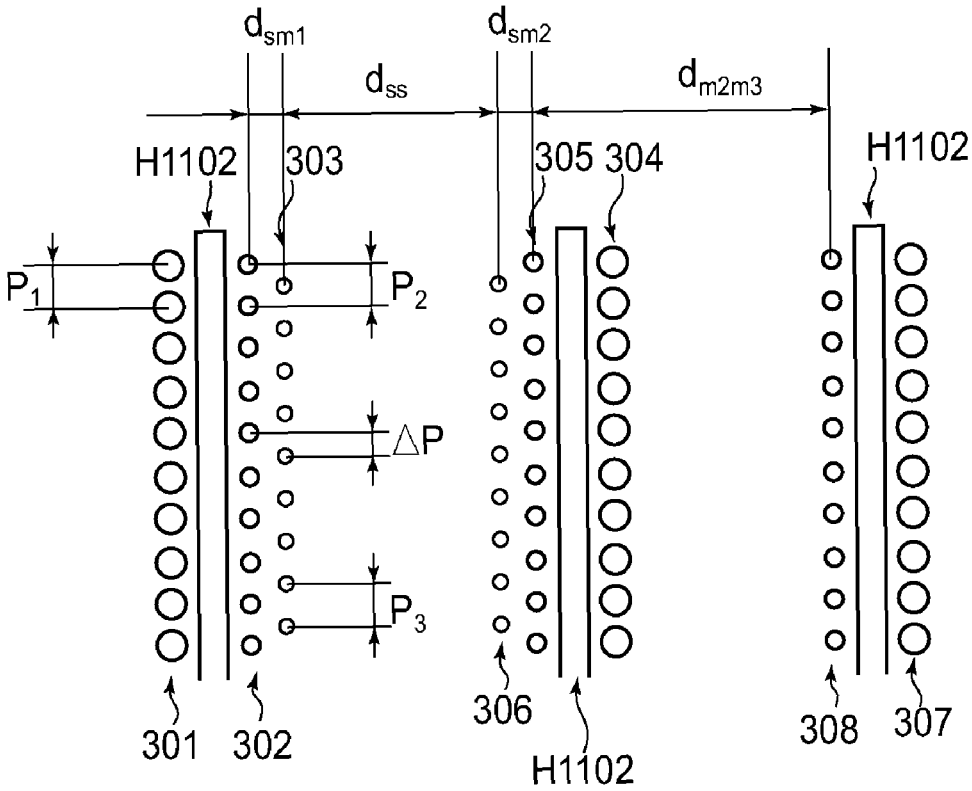
FIG. 6 is a schematic drawing which shows the arrangement of the ink ejecting openings in the first embodiment of the present invention.

FIG. 6 is a schematic drawing of the recording element H1101 of the above described ink jet cartridge H1001 in the first embodiment of the present invention, showing the arrangement of the ink ejecting openings (nozzle arrangement) as observed from the direction indicated by an arrow mark in FIG. 1(*a*).

The ink jet recording head in accordance with the present invention was made based on the above described referential example of an ink jet recording head, and its object is to record an image at a higher level of resolution and a higher level of precision than those at which the referential ink jet recording head can record an image. One of the methods for accomplishing this object is to provide an ink jet recording apparatus with not only large and small nozzle sets, such as those of the referential ink jet recording head, but also, a set or sets of nozzles which are smaller in size than the small nozzles of the referential ink jet recording head, and therefore, are capable of ejecting ink droplets smaller than those jetted by the abovementioned small nozzles. These smaller nozzles hereafter will be referred to as micro-nozzles (which are 1 pl, for example, in ink droplet volume, provided that large and small nozzles in this embodiment are the same in ink droplet volume as those of referential ink jet recording head).

Incidentally, the ink jet recording head in this embodiment is made up of yellow (Y) ink ejecting section, cyan ink ejecting section, and magenta ink ejecting section. However, yellow color is higher in lightness. Therefore, providing the yellow ink ejecting section of the ink jet recording head with an additional ink ejecting nozzle set made up of nozzles smaller than the abovementioned small nozzles, in order to enable the yellow ink ejecting section to record at three levels of gradation, is less meaningful, from the standpoint of its effect. Therefore, only the section for ejecting cyan (C) ink and section for ejecting magenta (M) ink are provided with a set of micro-nozzles.

In the case of an ink jet recording head, in which the set of large nozzles and set of small nozzles are positioned so that the former is positioned on the opposite side of the common ink supply passage from the latter, the set of micro-nozzles is desired to be positioned on the small nozzle side of the common ink passage as shown in FIG. 6, for the following reason. That is, when a given solid area of an image is formed of one of the secondary colors generated with the use of one of the combinations of two sets of micro-nozzles, or one of the combinations of the set of small nozzles and set of micro-nozzles, the smaller the distance between the two sets of nozzles used for image formation, the less nonuniform in color the solid area of the image.

Thus, in this embodiment, the multiple sets of ink ejecting openings (nozzles) are arranged as shown in FIG. 6. That is, the ink jet recording head is provided with three ink ejecting sections: first, second, and third ink ejecting sections. The first section has a first large nozzle set 301 made up of large nozzles, a first small nozzle set 302 made up of small nozzles, and a first micro nozzle set 303 made up of micro nozzles, and the second section has a second large nozzle set 304 made up of large nozzles, a second small nozzle set 305 made up of small nozzles, and a second micro nozzle set 306 made up of micro nozzles. The third section has a third large nozzle set 307 made up of large nozzles and a third small nozzle set 308 made up of small nozzles.

The first large nozzle set 301 is positioned on the opposite side on the corresponding ink supply passage H1102 from the first small nozzle set 302 and first micro nozzle set 303, and the second large nozzle set 304 is positioned on the opposite side of the corresponding ink supply passage H1102 from the second small nozzle set 305 and second micro nozzle set 306. The third large nozzle set 307 is positioned on the opposite side of the corresponding ink supply passage H1102 from the third small nozzle set 308. The nozzles in each nozzle set are arranged in a straight line, and the multiples nozzle sets 301-308 are parallel to each other. This structural arrangement makes it possible to provide each ink ejecting section with an ink different in type (color) from the inks supplied to the other ink ejecting sections, through the corresponding ink supply passage H1102. That is, each ink supply passage H1102 supplies the nozzles on the one side of the ink supply passage H1102 and the nozzles on the other side, with the same (in color) ink. Incidentally, the opening of each nozzle of the first, second, and third nozzle sets 301, 304, and 307 made up of large nozzles is given a proper size for ejecting 5 pl ink droplets. The ink passage which leads to each ink ejecting opening, and the electrothermal transducer element for each ink ejecting opening, are adjusted in measurement accordingly. Each ink ejecting opening of the first, second, and third small nozzle sets 302, 305, and 305-308 made up of small nozzles has the proper size for ejecting 2 pl ink droplets. The ink passage which leads to each ink ejecting opening, and the electrothermal transducer element for each ink ejecting opening, are adjusted in measurement accordingly. As for each ink ejecting opening of the first and second nozzle sets 303 and 306 made up of the micro nozzles, it is given a proper size for ejecting 1 pl ink droplets. The ink passage which leads to each ink ejecting opening, and the electrothermal transducer element for each ink ejecting opening, are adjusted in measurement accordingly.

As for the distances among the multiple nozzle sets, the distance $d_{Sm1}$ between the first small nozzle set 302 and first micro-nozzle set 303 is 0.048 mm; the distance $d_{Sm2}$ between the second small nozzle set 305 and second micro-nozzle set 306 is 0.048 mm; and the distance $d_{ss}$ between the first micro-nozzle set 303 and second micro-nozzle set 306 is 1.480 mm. The distance $d_{m2m3}$ between the second small nozzle set 305 and third small nozzle set 308 is 1.482 mm. As for the pitch of each nozzle set, the pitch P1 of each large nozzle set, pitch P2 of each small nozzle set, and pitch P3 of each micro-nozzle set, are all 42 μm. Further, in terms of the direction in which the ink ejecting openings of each nozzle set are aligned, the small nozzle set and corresponding micro-nozzle set are displaced relative to each other by a distance ΔP (which is 21 μm in this embodiment). Therefore, the nozzle density of each large nozzle set is 600 dpi, whereas the nozzle density of the combination of small nozzle set and micro-nozzle set in each ink ejecting section is 1,200 dpi.

The ink jet recording head in this embodiment, the nozzle arrangement of which is as described above, was tested for the nonuniformity of a solid image recorded in the secondary color, as were the referential ink jet recording head. The third large nozzle set 307 and third small nozzle set 308 was supplied with yellow (Y) ink; the first large nozzle set 301, first small nozzle set 302, and first micro nozzle set 303 were supplied with cyan ink; and the second large nozzle set 304, second small nozzle set 305, and second micro nozzle set 306 were supplied with magenta ink. The resultant images were free of the nonuniformities shown in FIGS. 4(*b*) and 4(*c*), regardless of color combination; excellent images were obtained.

In this embodiment, the distances from the first and second micro-nozzle sets 303 and 306 to the corresponding ink supply passages H1102 are greater than the distances from the first and second small nozzle sets 302 and 305 to the corresponding ink supply passages. However, as long as the distances $d_{sm1}$ and $d_{sm2}$ are no more than roughly 0.050 mm as they are in this embodiment, the distances from the first and second small nozzle sets 302 and 305 to the corresponding ink supply chambers may be greater than the distances from the first and second micro-nozzle sets 303 and 306 to the corresponding ink supply passage H1102.

Incidentally, in this embodiment, in terms of the direction in which the ink ejecting openings in each nozzle set are aligned, the large and small nozzle sets are 600 dpi in nozzle density, whereas the nozzle density of the combination of the small nozzle set and micro-nozzle set is 1,200 dpi. Next, the effect of this nozzle arrangement will be described.

It is reasonable to think that the higher the nozzle density, the greater the probability that the satellite ink droplets will float in the unstable air flow. A structural arrangement which is relatively low in nozzle density is relatively large in the distance between an ink droplet jetted from a given ink ejecting opening and an ink droplet jetted from the next ink ejecting opening, and therefore, a certain portion of the unstable air flow seems to flow through the spaces among ink droplets. In comparison, in the case of a structural arrangement which is high in nozzle density, the distance between the adjacent two ink droplets is relatively short, and therefore, the above-mentioned phenomenon is unlikely to occur, being therefore higher in the probability that the satellite ink droplets will be captured by the unstable air flow and float in the air flow. The distance between two nozzle sets which are high in nozzle density is desired to be as small as possible.

Embodiment 2

Figure 7:
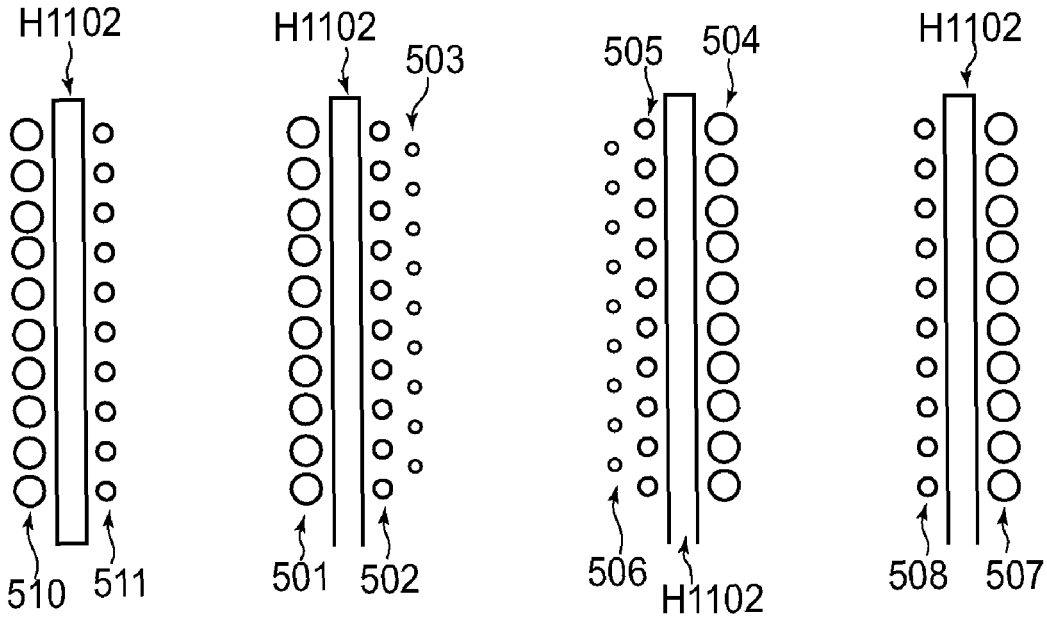
FIG. 7 is a schematic drawing which shows the arrangement of the ink ejecting openings in the second embodiment of the present invention.

FIG. 7 is a schematic drawing of the recording element H1101 of the ink cartridge H1001 in this embodiment, as seen from the same direction as the one indicated by an arrow mark in FIG. 1(*a*), showing the nozzle arrangement thereof. The ink jet recording head in this embodiment has one more ink ejecting section than the ink jet recording head in the above described first embodiment. That is, the ink jet recording head in this embodiment has first-fourth ink ejecting sections, and a total of ten ink ejecting opening sets made up of multiple ink ejecting openings described above. More specifically, the first ink ejecting section has a first large nozzle set 501, a first small nozzle set 502, and a first micro-nozzle set 503, and the second ink ejecting section has a second large nozzle set 504, a second small nozzle set 505, and a second micro-nozzle set 506. The third ink ejecting section has a third large nozzle set 507 and a third small nozzle set 508, and the fourth ink ejecting section has a fourth large nozzle set 510 and a fourth small nozzle set 511. The ink ejecting openings of each nozzle set are arranged in a straight line, and all the columns of the ink ejecting openings are parallel to each other. This structural arrangement makes it possible for four inks different in type to be supplied through the four ink supply passages H1102, one for one. The nozzles sets in each ink ejecting section are supplied with the same (in color) ink from the corresponding ink supply passage H1102. The ink ejecting opening of each nozzle of the first, second, third, and fourth large nozzle sets 501, 504, 507, and 510 is given a proper size for ejecting 5 pl ink droplets. Further, the ink passage leading to the opening of each nozzle, and the electrothermal transducer element therefor, are adjusted in measurement accordingly. The opening of each nozzle of each of the first, second, third, and fourth small nozzle sets 502, 505, 508, and 511 is given a proper size for ejecting 2 pl ink droplets. Further, the ink passage leading to the opening of each nozzle, and the electrothermal transducer element therefore, are accordingly adjusted in measurement. The opening of each nozzle of the first and second micro-nozzle sets 503 and 506 is given a proper size for ejecting 1 pl ink droplets. The ink passage leading to each ink ejecting opening, and the electrothermal transducer element for each nozzle, are adjusted in measurement accordingly.

In this embodiment, the first large nozzle set 501, first small nozzle set 502, and first micro-nozzle set 503 were used for ejecting droplets of cyan ink, and the second large nozzle set 504, second small nozzle set 505, and second micro-nozzle set 506 were used for ejecting droplets of magenta ink. Further, the third large nozzle set 507 and third small nozzle set 508 were used for ejecting droplets of yellow ink, and the fourth large nozzle set 510 and fourth small nozzle set 511 were used for ejecting droplets of black ink. The resultant images were as free from the nonuniformity in the areas of a secondary color as the images formed by the ink jet recording head in the first embodiment.

In this embodiment, the ink ejecting section for ejecting black ink is made up of the fourth large nozzle set 510 and fourth small nozzle set 511. When there is hardly any chance that a secondary color will be generated by using the black ink and one of the primary color inks, the same effects as those described above can be obtained. Further, even if a secondary color is generated with the use of black ink and one of the primary color inks, the same effects as those described above can be obtained, as long as the print duty is low, more specifically, no more than 25%. Moreover, even if the ink ejecting section for ejecting black ink is made up of a large nozzle set, a small nozzle set, and a micro-nozzle set as are the ink ejecting section for ejecting cyan ink and the ink ejecting section for ejecting magenta ink, the same effects as those described above can be obtained.

When designing an ink jet recording head, such as the above described one, which is capable of ejecting an additional ink beside cyan, magenta, and yellow inks, its nozzle sets are desired to be arranged as follows. That is, the combination of the nozzle set for ejecting cyan ink droplets, the volume of which is 2 pl, and the nozzle set for ejecting cyan ink droplets, the volume of which is 1 pl, and the combination of the nozzle set for ejecting magenta ink droplets, the volume of which is 2 pl, and the nozzle set for ejecting magenta ink droplets, the volume of which is 1 pl, are positioned next to each other, in the center portion of the ink jet recording head, in terms of the primary scan direction, and the nozzle sets for ejecting ink droplets of other colors are positioned on the outward sides of the combination of the small nozzle set and micro-nozzle set for ejecting cyan ink, and the small nozzle set and micro-nozzle set for ejecting magenta ink.

Further, when the additional ink is an ink, such as black ink, which normally is not used for generating a secondary color, it is desired that the combinational arrangement for the nozzle sets for cyan, magenta, and yellow inks is left as it is in the this embodiment, and the nozzle set for ejecting the additional ink is positioned outside the combination of the nozzle sets for cyan, magenta, and yellow inks.

Further, even if the color of the additional ink is red or green, the present invention is applicable, although the applicability depends on the lightness of the additional ink and the printing duty.

Additional Embodiments

Described above were the preferred embodiments of the present invention. However, these embodiments are not intended to limit the present invention in scope. That is, various modifications of these embodiments are also within the scope of the present invention, as long as the modifications are in accordance with the technical gist of the present invention.

FIG. 8(*a*) is a schematic drawing of one of the modifications of the recording elements in the preceding embodiments of the present invention, as seen from the same direction as the direction indicated by an arrow mark in FIG. 1(*a*), showing the nozzle arrangement thereof, and FIG. 8(*b*) is a schematic drawing of another modification of the recording element in the preceding embodiments of the present invention, as seen from the same direction as the direction indicated by an arrow mark in FIG. 1(*a*), showing the nozzle arrangement thereof.

In the case of the recording element shown in FIG. 8(*a*), multiple ink ejecting openings for ejecting 2 pl ink droplets (which are similar to those of ink jet recording head in first embodiment), and multiple ink ejecting openings for ejecting 1 pl ink droplets (which also are similar to those of ink jet recording head in first embodiment), are arranged in a single column. More specifically, the ink jet recording head has first to third ink ejecting sections, and each section has multiple (two in this modification) columns of the above described ink ejecting openings H1107. The first ink ejecting section has a first large nozzle set 601, a first small- and micro-nozzle set 602, and the second ink ejecting section has a second large nozzle set 604 and a second small- and micro-nozzle set 605. The third ink ejecting section has a third large nozzle set 607 and a third small nozzle set 608. The first and second small- and micro-nozzle sets 602 and 605 have multiple ink ejecting openings for ejecting 2 pl ink droplets and multiple ink ejecting openings for ejecting 1 pl ink droplets. Further, in the first and second small- and micro-nozzle sets 602 and 605, the small ink ejecting openings and micro-ink ejecting openings are alternately positioned. The multiple nozzle sets 601-608 are parallel to each other. The first large nozzle set 601 is positioned on the opposite side of the corresponding ink supply passage H1102 from the first small- and micro-nozzle set 601; the second large nozzle set 604 is positioned on the opposite side of the corresponding ink supply passage H1102 from the second small- and micro-nozzle set 605; and the third large nozzle set 607 is positioned on the opposite side of the corresponding ink supply passage H1102 from the third small nozzle set 608. This structural arrangement makes it possible to supply three inks different in type through three ink supply passages H1102, one for one. Incidentally, each ink ejecting opening of the multiple nozzle sets of which the first, second, and third large nozzle set 601, 604, and 607 are made up is given a proper size for ejecting 5 pl ink droplets. The ink passage leading to each ink ejecting opening, and the electrothermal transducer element therefor, are adjusted in measurement accordingly. Further, in the first and second small- and micro-nozzle sets 602 and 605, and third small nozzle set 608, each ink ejecting opening is given a proper size for ejecting 2 pl ink droplets. Further, the ink passage leading to each ink ejecting opening, and the electrothermal transducer element therefore, are adjusted in measurement according to the size of the ink ejecting opening. In the first and second small- and micro-nozzle sets 602 and 605, each ink ejecting opening is given a proper size for ejecting 1 pl ink droplets. Further, the ink passage leading to the ink ejecting opening, and the electrothermal transducer element therefor, are adjusted in measurement to jet 1 pl ink droplets.

In this embodiment, the first large nozzle set 601 and first small- and micro-nozzle set 602 are used for ejecting cyan ink, and the second large nozzle set 604 and second small- and micro-nozzle set 605 are used for ejecting magenta ink. The third large nozzle set 607 and third small nozzle set 603 are used for ejecting yellow ink. This structural arrangement can prevent the formation of an image which is nonuniform in color across the areas having a secondary color, as can the structural arrangement in the above described first embodiment.

This structural arrangement in which the ink ejecting openings for ejecting 2 pl ink droplets and the ink ejecting openings for ejecting 1 pl ink droplets are alternately arranged in a single column is effective to reduce chip size. Incidentally, in this modification of the preferred embodiments, the nozzle sets 601, 604, 607, and 608 are 600 dpi in nozzle density, and the nozzle set 602 and 605 are 1,200 dpi in nozzle density.

FIG. 8(*b*) is a schematic drawing of another modification of the recording elements in the preceding embodiments of the present invention, as seen from the same direction as the direction indicated by an arrow mark in FIG. 1(*a*), showing the nozzle arrangement thereof. In this modification, in each ink ejecting sections, the openings of the small nozzle set form one line, and the openings of the micro-nozzle set form another line. Further, neither the openings of the small nozzle set, nor the openings of the micro-nozzle set, forms a straight column. The first large nozzle set 701 is positioned on the opposite side of the corresponding ink supply passage H1102 from the first small nozzle set 702 and first micro-nozzle set 703. The second large nozzle set 704 is positioned on the opposite side of the corresponding ink supply passage H1102 from the second small nozzle set 705 and second micro-nozzle set 706. The third large nozzle set 707 is positioned on the opposite side of the corresponding ink supply passage H1102 from the third small nozzle set 708.

This structural arrangement makes it possible to supply three inks different in type through three ink supply passages H1102, one for one. Incidentally, each ink ejecting opening of the nozzles of which the first, second, and third large nozzle set 701, 704, and 707 are made up is given a proper size for ejecting 5 pl ink droplets. The ink passage leading to each of these ink ejecting openings, and the electrothermal transducer element therefor, are adjusted in measurement accordingly. Further, each ink ejecting opening of the nozzles of which the first, second, and third small nozzle sets 702, 705, and 708 are made up is given a proper size for ejecting 2 pl ink droplets. The ink passage leading to each of these ink ejecting openings, and the electrothermal transducer element therefor, are adjusted in measurement accordingly. Moreover, each ink ejecting opening of the nozzles of which the first and second micro-nozzle sets 703 and 706 are made up is given a proper size for ejecting 1 pl ink droplets. The ink passage leading to each of these ink ejecting openings, and the electrothermal transducer element therefor, are adjusted in measurement accordingly. In this modification, in the small nozzle sets 702, 705, and 708, and also, in the micro-nozzle sets 703 and 706, the ink ejecting openings do not form a straight line; the ink ejecting openings are separated into groups of four ink ejecting openings, and the four ink ejecting openings in each group are slightly staggered from the next ink ejecting openings in the primary scan direction. In other words, the ink ejecting openings are arranged in a manner of slightly snaking. That is, each of the small nozzle sets 702, 705, and 708, and micro-nozzle sets 703 and 706, is a sequential assemblage of multiple groups, each of which is made up of a preset number (four in this modification) of ink ejecting openings, and in which the preset number of ink ejecting openings are slightly staggered relative to the next ink ejecting offices in the primary scan direction.

Incidentally, sequentially driving the electrothermal transducer elements makes it possible prevent electrical current from flowing through all the electrothermal transducer elements at the same time, being therefore advantageous in that it can reduce the amount of peak current. However, an ink jet recording head in which the ink ejecting openings in each nozzle sets are arranged in a straight line as in the first embodiment is problematic in that it is difficult to print a long straight line by sequentially driving the nozzles of each of its nozzle sets, and therefore, it is difficult to print a table with clean ruled line, or ruled lines. In comparison, an ink jet recording head, such as the one in this modification of the preceding embodiments, shown in FIG. 8(*b*), in which the ink ejecting openings of each of the small nozzle sets 702, 705, and 708, and micro-nozzle sets 703 and 706 are not in a straight line, is thought to be effective for recording a clean straight ruled line.

Through the above described three ink supply passages H1102, cyan, magenta, and yellow inks are supplied, one for one. In this modification, the nozzle sets 701, 702, and 703 are used for ejecting cyan ink, and the nozzle sets 704, 705, and 706 are used for ejecting magenta ink. The nozzle sets 707 and 708 are used for ejecting yellow ink. The ink jet recording head in this modification is the same in the level of nonuniformity of the image areas of a secondary color as the ink jet recording head in the above described preferred embodiments; the nonuniformity was virtually impossible to detect.

As described above, not only is the present invention applicable to an ink jet recording head in which the ink ejecting openings of each of multiple nozzle sets are in a straight line, but also, an ink jet recording head in which the ink ejecting openings of each of the multiple nozzle sets are not in a straight line, for example, an ink jet recording head in which each nozzle set is a sequential assemblage of multiple groups made up of a preset number of ink ejecting openings, and the ink ejecting openings in each group are staggered relative to the next ink ejecting openings in the primary scan direction, or an ink jet recording apparatus in which the ink ejecting openings of each nozzle set are arranged in a zigzag pattern.

INDUSTRIAL APPLICABILITY

As described hereinabove, according to the present invention, it is possible to provide an ink jet recording head which is provided nozzles capable of ejecting ink droplets substantially smaller in size than those jetted by an ink jet recording head in accordance with the prior art, in order to yield an image substantially higher in quality than an image formed by an ink jet recording head in accordance with the prior art, and yet, is capable of forming a high quality image at a high speed.

While the invention has been described with reference to the structures disclosed herein, it is not confined to the details set forth, and this application is intended to cover such modifications or changes as may come within the purposes of the improvements or the scope of the following claims.

The invention claimed is:

1. An ink jet recording head comprising:

at least three nozzle array groups, wherein each of said nozzle array group include:

a first nozzle array including a plurality of ejection outlets for ejecting ink, and a second nozzle array including a plurality of ejection outlets for ejecting the ink, said second nozzle array being disposed adjacent to said first nozzle array with an ink supply port for supplying the ink interposed therebetween, wherein an opening area of the ejection outlets of said second nozzle array is smaller than an opening area of the ejection outlets of said first nozzle array, wherein said nozzle array groups eject three different kinds of inks, respectively, when said ink jet recording head moves relative to a recording material, wherein nozzle arrays of adjacent nozzle array groups of said at least three nozzle array group are arranged in an order of said first nozzle array of a first nozzle array group of said adjacent nozzle array groups, said second nozzle array of said first nozzle array group, said second nozzle array of a second nozzle array group of said adjacent nozzle array groups, and said first nozzle array of said second nozzle array, wherein a third nozzle array is provided in each of said adjacent nozzle array groups, each said third nozzle array including a plurality of ejection outlets for ejecting the ink, wherein an opening area of the ejection outlets of said third nozzle array is smaller than an opening area of the ejection outlets of said second nozzle array, said third nozzle array being disposed at a same side as said second nozzle array with respect to said ink supply port, and wherein a third nozzle array group of said at least three nozzle array groups which is not one of said adjacent nozzle array groups is supplied with the ink having a highest lightness among the three kinds of inks.

2. An ink jet recording head according to claim 1, wherein the three kinds of inks are yellow ink, magenta ink and cyan ink, and wherein one of said first and second nozzle array groups is supplied with the cyan ink, the other of said first and second nozzle array groups is supplied with the magenta ink, and said third nozzle array group is supplied with the yellow ink.

3. An ink jet recording head according to claim 1, wherein said ink supply ports of said at least three nozzle array groups are formed in a common substrate.

4. An ink jet recording head according to claim 1, further comprising a fourth nozzle array group, provided outside said first, second and third nozzle array groups, for ejecting black ink.

5. An ink jet recording head according to claim 1, wherein arrangement densities of nozzles in each said second nozzle array and third nozzle array are higher than an arrangement density of the nozzles in each said first nozzle array.

6. An ink jet cartridge comprising an ink jet recording head as defined in claim 1, and an ink accommodating portion for accommodating three kinds of inks to be supplied to said ink jet recording head, and wherein the ink in the ink accommodating portion accommodating the ink to be supplied to said third nozzle array group has a lightness which is higher than that of the ink contained in another ink accommodating portion.

7. An ink jet recording apparatus comprising an ink jet recording head as defined in claim 1, and a carriage for scanningly moving said ink jet recording head.

* * * * *